US005250000A

United States Patent [19]

Boutin et al.

[11] Patent Number: 5,250,000

[45] Date of Patent: Oct. 5, 1993

[54] PLAY KIT WITH DETACHABLE PLAY SURFACE

[76] Inventors: Stephen J. Boutin; Sally L. Boutin, both of 441 Winter St., Hanover, Mass. 02339

[21] Appl. No.: 864,629

[22] Filed: Apr. 7, 1992

[51] Int. Cl.[5] ..... A63H 33/04; A63H 33/06; A63H 33/08; A63F 3/00

[52] U.S. Cl. ..... 446/75; 446/118; 446/128; 273/282.2; 273/284; 206/315.1; D6/406

[58] Field of Search ..... 446/76, 75, 74, 73, 446/72, 71, 118, 117, 128, 479, 482, 901; 273/282.2, 284, 287; 206/315.1; 190/900; D6/406, 419; D18/45; D19/36, 52; D21/121, 14

[56] References Cited

U.S. PATENT DOCUMENTS

| | | | |
|---|---|---|---|
| D. 287,741 | 1/1987 | Taylor | D21/121 |
| 1,151,470 | 8/1915 | Kade . | |
| 2,095,482 | 10/1937 | Spicciato | 273/284 |
| 2,896,950 | 7/1959 | Rosti et al. . | |
| 4,179,127 | 12/1979 | Goodman | 273/284 X |
| 4,271,566 | 6/1981 | Perina . | |
| 4,372,224 | 2/1983 | Ehrlich . | |
| 4,483,427 | 11/1984 | Gerch | 190/900 X |
| 4,513,974 | 4/1985 | Lin | 273/287 X |
| 4,671,514 | 6/1987 | Wilson-Diehl | 273/282.2 X |
| 4,822,314 | 4/1989 | O'Brian et al. | 446/128 X |
| 4,846,382 | 7/1989 | Foultner et al. . | |
| 4,872,410 | 10/1989 | Lilly . | |
| 4,872,550 | 10/1989 | Stranges | 206/315.1 |
| 4,926,758 | 5/1990 | Lilly et al. . | |
| 5,007,569 | 4/1991 | Zarb | 446/75 X |
| 5,055,081 | 10/1991 | Nayak | 446/75 |
| 5,115,893 | 5/1992 | Terkildsen | 190/900 X |

FOREIGN PATENT DOCUMENTS

| | | | |
|---|---|---|---|
| 934552 | 10/1973 | Canada | 446/128 |
| 1164295 | 2/1964 | Fed. Rep. of Germany | 446/128 |

OTHER PUBLICATIONS

Table Toys Brochure, 4 pages.
Lego dacta description, 1 page.
"Let's Go Lego" Sunday Republican, May 5, 1991.

*Primary Examiner*—Robert A. Hafer
*Assistant Examiner*—D. Neal Muir
*Attorney, Agent, or Firm*—Fish & Richardson

[57] ABSTRACT

A play kit, including a carrying case with a storage volume sized to enclose therewithin and allow removal therefrom a play tray and a play sheet. The play tray includes a rigid planar supporting member having first and second planar surfaces. The first surface is a bearing surface for bearing against a foreign surface to support the tray in use and the second surface is a mating surface with a demateable attachment elements for demateable attachment of the play sheet. The supporting member it is bordered by opposing vertical extension members extending beyond the first surface of the supporting member and sized to limit sliding motion in the plane of the play tray. The play sheet includes first and second surfaces. The first surface is adaptable for use as a game or toy and the second surface is substantially planar and includes demateable attachment elements corresponding to the attachment elements on the second surface of the supporting member for demateable attachment of the play sheet with the play tray. The play tray may be used as a table elements.

15 Claims, 4 Drawing Sheets

PLAY KIT WITH DETACHABLE PLAY SURFACE

FIELD OF THE INVENTION

This invention relates to play surfaces of the type often used by children.

BACKGROUND OF THE INVENTION

Children commonly play with toys or games of type employing a substantially planar play surface, such as, for example, checkers, drawing boards, chessboards, etc. Certain building block toys which detachably snap together by virtue of complementary mating features, e.g., Lego ®-type building block toys, may also be used with substantially planar sheet members carrying the characteristic mating features on one side of the sheet for attachment to loose blocks.

SUMMARY OF THE INVENTION

An aspect of the invention is a play kit which will occupy a child for an extended period of time, especially when a child is confined, for example, in an automobile or a hospital bed, by providing a variety of games and/or other activities for the child, such as building blocks, checkers, drawing board, etc., on a play surface held in the secure fashion on a supporting surface that fits neatly in the child's lap or on a table, e.g., a hospital bed table. Another aspect of the invention is play surfaces that are removable from the supporting surface for easy cleaning and thus reduce the risk of transmission of infectious diseases in a hospital setting.

In a first particular aspect, the invention features a play kit including a carrying case with a storage volume sized to enclose therewithin and allow removal therefrom a play tray and a play sheet. The play tray includes a rigid planar supporting member having first and second planar surfaces. The first surface is a bearing surface for bearing against a foreign surface to support the tray in use and the second surface is a mating surface with a demateable attachment means for demateable attachment of a play sheet. The supporting member is at least partially bordered by opposing vertical extension members extending beyond the first surface of the supporting member and sized to limit sliding motion in a direction in the plane of the play tray. The play sheet includes first and second surfaces. The first surface is adaptable for use as a game or toy and the second surface is substantially planar and includes demateable attachment means corresponding to the attachment means on the second surface of the supporting member for demateable attachment of the play sheet with the play tray.

Preferred embodiments may include one or more of the following features. The attachment means are hook and loop connectors disposed on the second surface of said supporting member of the play tray and the second surface of the play sheet. The carrying case is a box member having a storage portion with a supporting wall and a cover portion connected by hinge and the play tray vertical members are constructed to bear on the supporting wall when the tray is not in use to position the supporting surface above the supporting wall to create a storage space therebetween. The play sheet comprises a sheet adapted for use with a demateable building block toy. An alternate play sheet is provided that is also adaptable for attachment to the second surface of the supporting member and is sized for storage in the storage space between the supporting surface and supporting wall of the storage case, when not in use. The first surface of the alternate play sheet has a checker board pattern on its second surface. The supporting wall includes pedestal members to position at least a portion of the play tray above and unencumbered by the storage portion for easy removal of the play tray from the carrying case. The vertical members extend vertically beyond the first and second surface of the support member. The vertical members extend symmetrically beyond the first and second surfaces of the support member. The support member includes detachable attachment means on the first surface. The support member and vertical members are constructed to allow positioning of the support member on a standard hospital bed tray-table, with the vertical members extending over the edge of the table to limit sliding motion. The vertical members are separated by about 15 inches at the closest dimension. The play tray is generally rectangular and the vertical extension members border the support member only on two opposing sides to limit sliding motion in the direction perpendicular to the sides and allow sliding motion in the direction parallel to the opposing sides. The vertical members extend vertically about 1 inch beyond the supporting member. The bag member for carrying loose toys, the bag member including a reversible attachment means corresponding to an attachment means on the carrying case. The bag member is attachable to the cover inside the carrying case.

In another particular aspect the invention features a play tray including a play table with a rigid planar supporting member having a substantially planar surface and a play sheet. The supporting member has a demateable attachment means for demateable attachment of the play sheet and is bordered by vertical extension members extending vertically beyond the supporting member. The play sheet includes first and second surfaces, where the first surface adaptable for use as a game or toy and the second surface is substantially planar and includes demateable attachment means corresponding to the attachment means on the second surface of the supporting member for demateable attachment of the play sheet with the play tray.

Preferred embodiments may include features mentioned above and embodiments above may include features below. Most preferably. The attachment means are hook and loop connectors disposed on the second surface of the supporting member of the play tray and the second surface of the play sheet. The play sheet is a sheet adapted for use with a demateable building block toy. The support surface can support at least about 30 lbs.

Other features follow.

BRIEF DESCRIPTION OF THE DRAWING

We first briefly describe the drawings.

Drawings

DESCRIPTION OF THE PREFERRED EMBODIMENT

Figure 1:
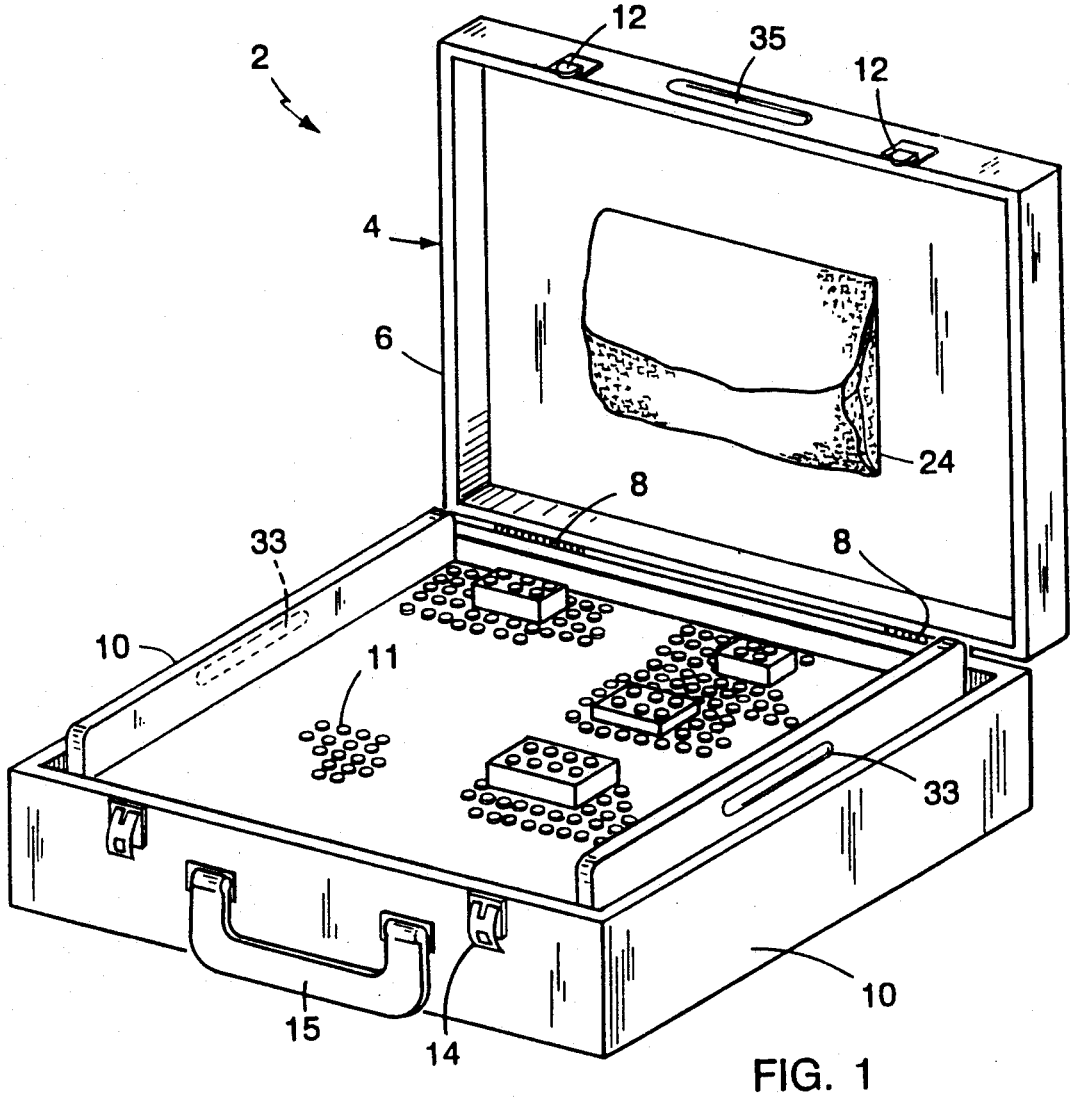
FIG. 1 is a perspective view of a play kit according to the invention with the cover of the carrying case open, and the play tray and a play surface of the kit assembled within the case.

Referring to FIG. 1, a play kit 2 according to the invention is shown to include a carrying case 4 with a cover 6 connected by hinges 8 to a storage portion 10. The cover 6 includes closure means 12 such as snaps or buckles which mate with corresponding means 14 on the storage portion 10. The cover 6 includes a groove 35 for ease of opening. Storage portion 10 further includes a handle 15, which may be used for convenient transport of the kit when the cover 6 is closed over storage portion 10 and locked by engagement of members 12 and 14.

Figure 2:
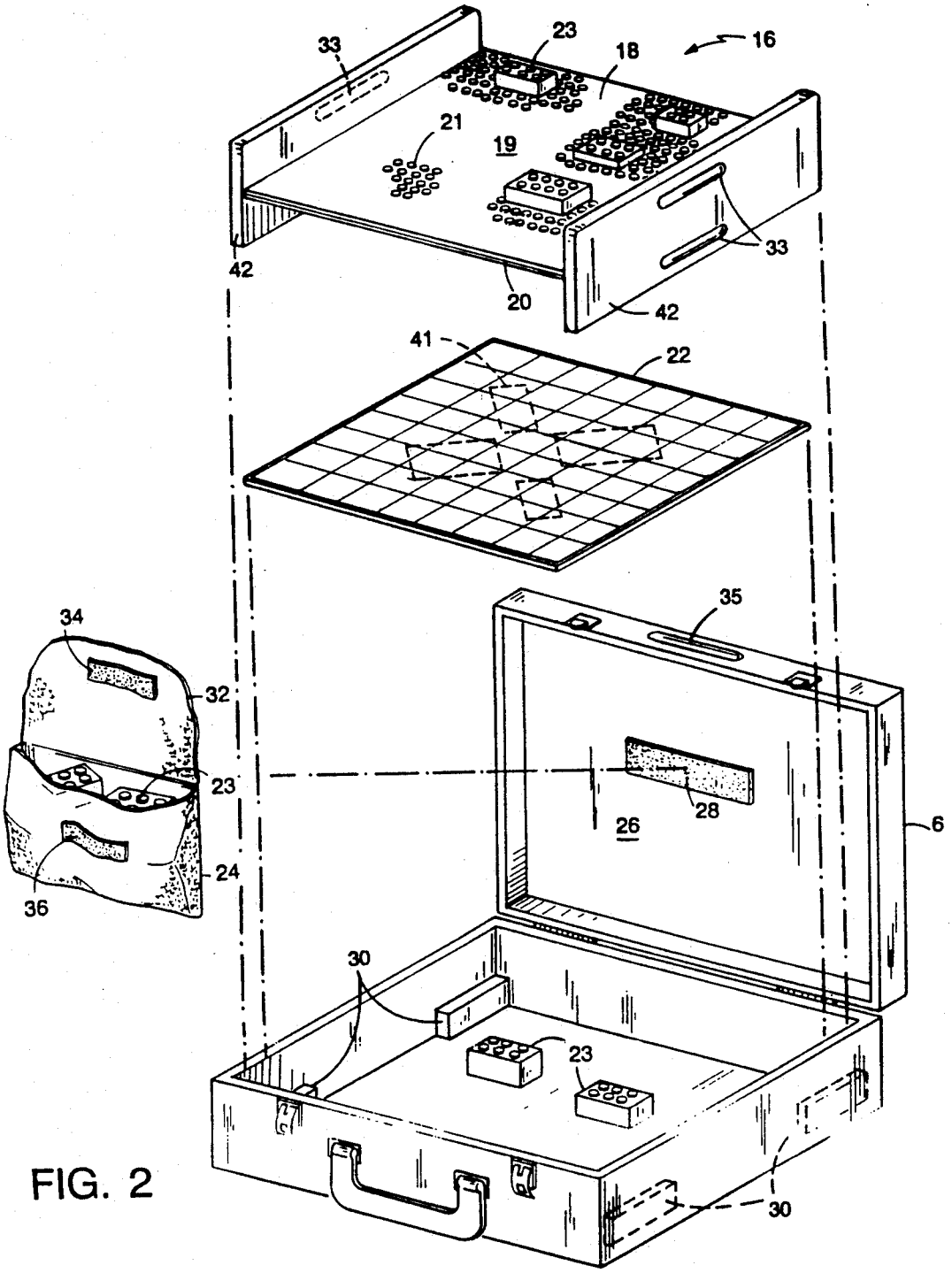
FIG. 2 is an exploded view of the play kit in FIG. 1 and its contents.

Referring as well to FIG. 2, the case 4 is sized and constructed to contain and allow removal therefrom of a play tray 16. The storage portion 10 includes support pedestals 30 which support the play tray 16, such that the groove members 33 are exposed above the side walls of the storage portion to be easily grasped and to provide ample room beneath the play tray for storage. The play tray 16 is adapted to hold a play sheet 18 such as a lego sheet (available from Lego, Enfield, Conn.) on a support member 20. The exposed surface 19 of the Lego® sheet 18 includes raised features 21 characteristic of Lego®-type building blocks for detachable mating with loose blocks 23. The kit further includes an alternate play surface 22, such as a checkerboard, which may typically be stored in the storage portion 10 beneath the play tray 16. A bag member 24 is detachable from the back surface 26 of the cover 6 using a hook and loop type attachment strip 28, e.g., a Velcro® strip, attached (for example, glued) thereupon and a corresponding strip (not shown) attached to the back of the bag 24. The bag provides a container for loose toy pieces, for example, Lego® blocks, checkers, crayons and the like used with various play surfaces. As illustrated, the bag preferably includes a flap 32 with a detachable hook and loop strip 34 matable with the strip 36/on the body of the bag 24 for easy closure and containment of the contents. The cover 6 is of selected depth to allow easy closure of the cover with the bag 24, including play items, attached.

Figure 3:
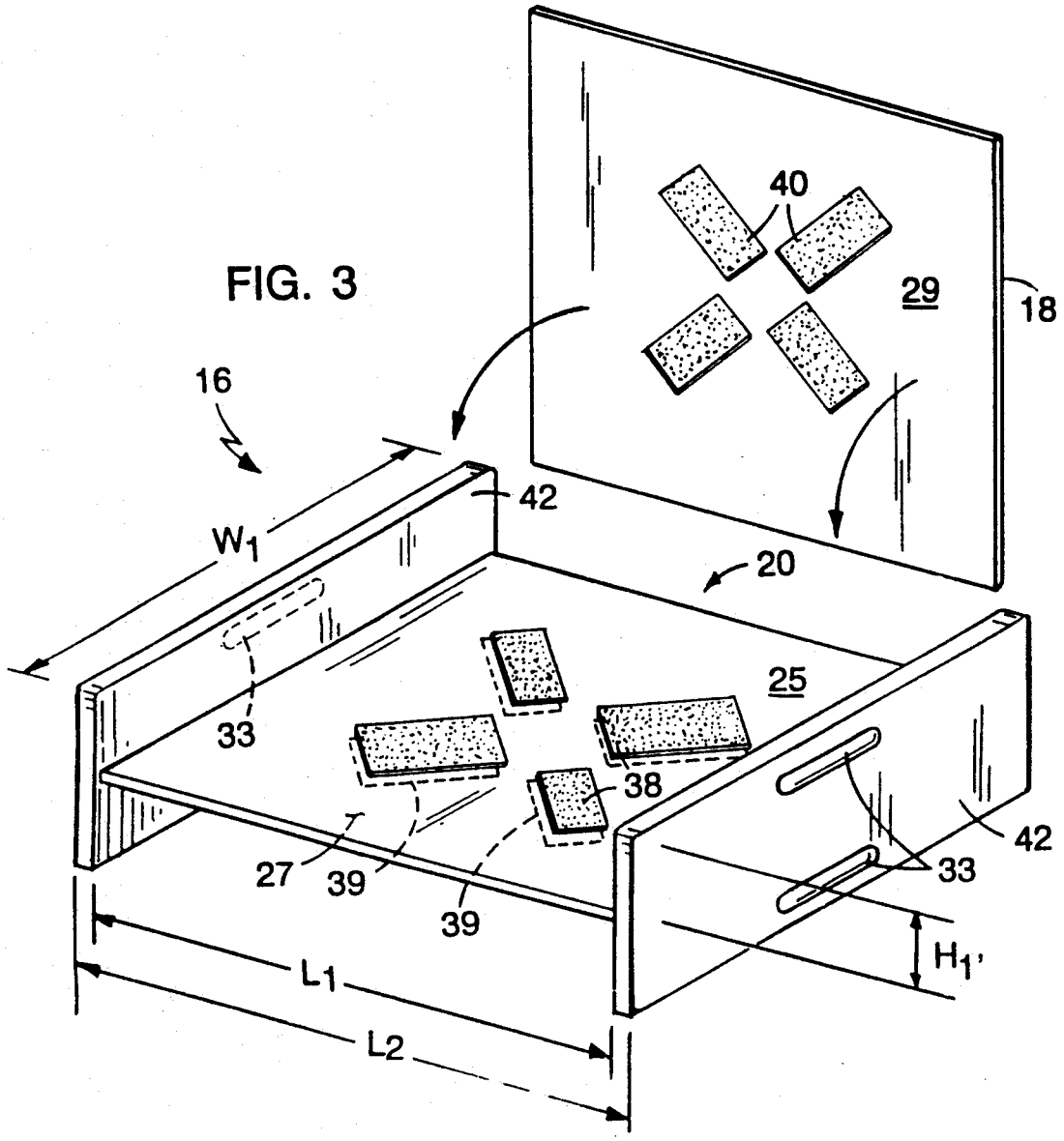
FIG. 3 is an illustration of dematable attachment of a play surface from a play tray.

Referring as well to FIG. 3, the play tray 16, includes on the upper surface 25 of support member 20, strips of hook and loop demateable attachment means 38 which are matable with corresponding attachment means 40 on the back surface 29 of the play surface 18. Similarly, alternate play surface 22 includes a corresponding pattern of attachment 41 means (shown in phantom, FIG. 2) to allow interchange of the play surface on the play tray 16 by the child. It is a particular advantage of the present invention that the play surfaces 18, 22 be demateable from the play tray 16, not only for variation of activity by the child, but as well for ease of cleaning of the play surface (preferably formed of plastic), for example, in a hospital setting or a physician's office where the play surface can be easily washed in a sink before being passed from child to child thereby minimizing the risk of disease transmission.

Figure 4:
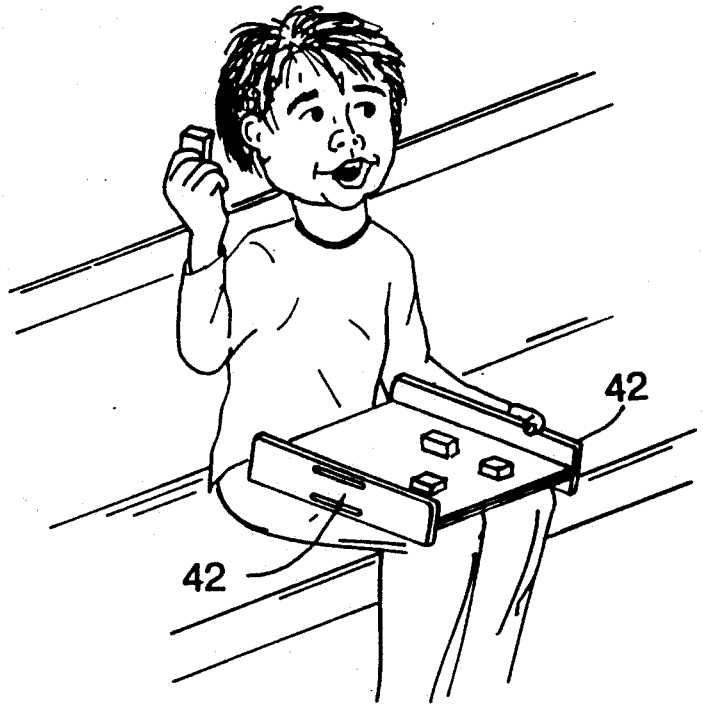
FIGS. 4 and 4*a* illustrate positioning the play tray on a child's lap and a hospital bed table, respectively.

As illustrated, the play tray 16, includes a pair of opposing vertical extension members 42 which members extend preferably symmetrically from either side of the plane of support member 20, $H_1$, about 1 inch. The extension members allow the play tray 16 to be neatly placed on a foreign surface, typically in the lap of the child, as illustrated in FIG. 4, and limit side to side sliding motion in the plane of the play tray in a direction perpendicular to the extension of the vertical members. The toy, however, slides easily in a direction parallel to the sides bordered by vertical member 42. The extension of the vertical members above the exposed surface of the play surface 18 help contain the loose pieces used while playing with the play surface, for example, checkers, building blocks or the like.

Figure 4A:
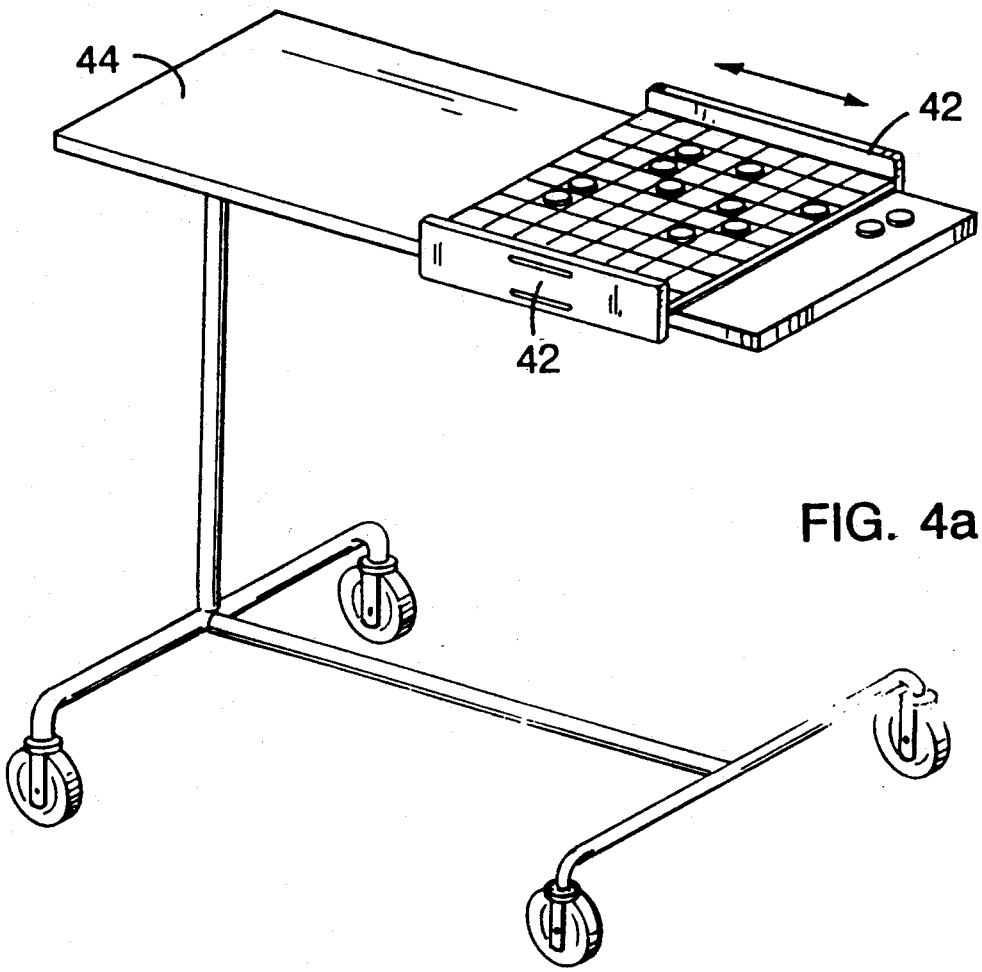

Referring as well to FIG. 4*a*, preferably the vertical members 42 and the support member 20 are sized and adapted so that the tray may be easily placed vertically or slid onto a hospital bed tray 44. Preferably the inside distance between the vertical members is $L_1$, about 15 inches, and the outer distance between the vertical members is $L_2$, about 16 inches. The play tray has a width $W_1$ about 15 inches. The support member 20 is made of thickness and material to maintain a substantially planar play surface without excessive bending as the child bears on it during play at a portion not directly supported by a foreign surface, e.g., at the edge when the tray is supported on a small child's lap. In one embodiment, the support member 20 is about ⅜ inch thick and formed of wood (hard rock maple). The vertical members 42 are also wood and attached to the support member 20 by rabbited groove ⅜ inch wide by ¼ inch deep, running the full length of the vertical member, and gluing and nailing the support members to the vertical member grooves. In the embodiment described, the play tray with the support member can support about 150 lbs. Preferably, the play tray is constructed to at least support the weight of a small child, e.g., greater than about 30 lbs. Referring, as well, back to FIGS. 1 and 2, as discussed, the play tray 16 and carrying case 4 are cooperatively constructed. Preferably, the storage portion support pedestals 30 are wood blocks measuring 3 inches long by ½ inch thick by 1¼ inch wide and arranged to extend this latter distance from the floor of the storage portion (FIG. 2). With the play tray in the storage position, the vertical support members extend about ¾ inch above the side walls of the storage portion so that the groove members 2 are easily grasped for removal of the play tray (FIG. 1).

In other embodiments, optional connector strips, such as strips 39, (phantom and offset from attachment means 38 for clarity, FIG. 3) are provided on the opposite side 27 (phantom, FIG. 3) of the support member 20 so that a play surface may be attached to either side of the support. The depth of the storage member 10 and vertical is selected such that multiple alternate play surfaces can be stored beneath the support surface. Other play surfaces are possible, for example, larger building block-type surfaces, e.g., Lego-Dacta® surfaces or erasable writing surfaces. The play tray may be of other geometries, e.g. circular. The vertical members may be positioned variously about the sides of the support member to allow or prevent sliding motion as desired. The support member may be used as a table member with removable play surfaces, e.g., the vertical members may be constructed as table-leg members to support the support member on a floor, etc. Materials other than wood may be used.

Other embodiments are in the following claims:

What is claimed is:

1. A play kit, comprising:

a carrying case defining a storage volume sized to enclose therewithin and allow removal therefrom a play tray and a play sheet, said carrying case comprising a bottom surface and a pedestal means for supporting said play tray within said carrying case at a position spaced from said bottom surface of said carrying case, said play tray including a rigid planar supporting member having a substantially planar first under surface and a substantially planar second, upper surface, said first, under surface, in use, adapted to bear against a foreign surface to support said tray, and said second, upper surface defining a mating surface with a demateable attachment means for demateable attachment of said play sheet upon said second, upper surface, said supporting member being at least partially bordered by opposing vertical extension members extending below a plane of said first, under surface of said supporting member, said opposing vertical extension members being sized to limit sliding motion of said supporting member in a direction in the plane of said first, under surface, and said play sheet including first and second surfaces, said first surface adaptable for use as a game or toy and said second surface being substantially planar and including demateable attachment means corresponding to the attachment means on the second surface of said supporting member for demateable attachment of said play sheet with said play tray.

2. The play kit of claim 1 wherein said attachment means comprises hook and loop connectors disposed on the second surface of said supporting member of said play tray and said second surface of said play sheet.

3. The play kit of claim 2 wherein the carrying case is a box member having a storage portion with a supporting wall and a cover portion connected by hinge and said play tray vertical members are constructed to bear on said supporting wall when said tray is not in use to position said supporting surface above said supporting wall to create a storage space therebetween.

4. The play kit of claim 3 wherein the play sheet comprises a sheet adapted for use with a demateable building block toy.

5. The play kit of claim 4 further comprising an alternate play sheet also adaptable for attachment to said second surface of said supporting member and being sized for storage in said storage space between said supporting surface and supporting wall of said storage case, when not in use.

6. The play kit of claim 5 wherein said first surface of said alternate play sheet comprises a checker board pattern on its second surface.

7. The play tray of claim 3 wherein said supporting wall includes pedestal members to position at least a portion of said play tray above and unencumbered by said storage portion for easy removal of said play tray from said carrying case.

8. The play kit of claim 1 wherein said vertical members extend vertically above said second, upper surface of said support member.

9. The play kit of claim 8 wherein said support member includes detachable attachment means on said first surface.

10. The play kit of claim 1 wherein said support member and vertical members are constructed to allow positioning of said support member on a standard hospital bed tray-table, with said vertical members extending over the edge of said table to limit sliding motion.

11. The play kit of claim 10 wherein said vertical members are separated by about 15 inches at the closest dimension.

12. The play kit of any one of claims 1, 3, 4, 8, 10 or 11 wherein said play tray is generally rectangular and said vertical extension members border said support member only on two opposite sides to limit sliding motion in the direction perpendicular to said opposite sides and allow sliding motion in the direction parallel to said opposite sides.

13. The play kit of any one of claims 1, 3, 4, 8, 10 or 11 wherein said vertical members extend vertically about 1 inch beyond said supporting member.

14. The play kit of claim 1 or 3 further comprising a bag member for carrying loose toys, said bag member including a releasable attachment means corresponding to an attachment means on said carrying case.

15. The play kit of claim 14 wherein said bag member is attachable to the cover inside said carrying case.

* * * * *

UNITED STATES PATENT AND TRADEMARK OFFICE

CERTIFICATE OF CORRECTION

PATENT NO. : 5,250,000

DATED : October 5, 1993

INVENTOR(S) : Stephen J. Boutin, Sally L. Boutin

It is certified that error appears in the above-indentified patent and that said Letters Patent is hereby corrected as shown below:

On the Title Page, Item [57], in the last line delete "elements".
Column 3, line 42, delete "/".
Column 3, line 63, after "16" delete ",".

Signed and Sealed this

Thirtieth Day of August, 1994

*Attest:*

*Attesting Officer*

BRUCE LEHMAN

*Commissioner of Patents and Trademarks*